US005868044A

United States Patent [19]

Sonderman

[11] Patent Number: 5,868,044

[45] Date of Patent: Feb. 9, 1999

[54] BOTTLE STOPPER REMOVER

[76] Inventor: Harry P. Sonderman, 39930 Whitewood Rd., Apt. #P-102, Murrieta, Calif. 92563

[21] Appl. No.: 641,012

[22] Filed: Apr. 25, 1996

[51] Int. Cl.[6] ..... B67B 7/06

[52] U.S. Cl. ..... 81/3.29; 81/3.37

[58] Field of Search ..... 81/3.07, 3.08, 81/3.33, 3.36, 3.37, 3.29, 3.45

[56] References Cited

U.S. PATENT DOCUMENTS

| | | | |
|---|---|---|---|
| 58,820 | 10/1866 | Hazard . | |
| 593,699 | 11/1897 | Stoll | 81/3.37 |
| 2,162,445 | 7/1939 | Richel | 226/88 |
| 4,018,110 | 4/1977 | Spriggs | 81/3.1 B |
| 4,422,355 | 12/1983 | Burns, Jr. | 81/3.36 |
| 4,590,821 | 5/1986 | Olson | 81/3.29 X |
| 4,708,033 | 11/1987 | Eash | 81/3.37 |
| 4,756,214 | 7/1988 | Valtri et al. | 81/3.4 |
| 4,768,403 | 9/1988 | Bar-Noy | 81/3.15 |
| 4,798,106 | 1/1989 | Foster | 81/3.29 |
| 4,875,394 | 10/1989 | Crudgington, Jr. | 81/3.08 |
| 4,947,711 | 8/1990 | Giebeler | 81/3.29 X |
| 5,347,889 | 9/1994 | St. Denis | 81/3.29 |

*Primary Examiner*—D. S. Meislin

*Attorney, Agent, or Firm*—Gene Scott; Patent Law & venture Group

[57] ABSTRACT

A stopper remover for a wine bottle, providing a movable and a fixed U-shaped jaws. The fixed jaw develops leverage against the sloping surface of the neck of the bottle while the movable jaw engages the stopper. A screw develops mechanical advantage for separating the jaws to pull the cork. The movable jaw is easily replaceable with a jaw of alternate configuration so that the device is useful for a range of stopper types. A return spring is used to allow the movable jaw to be reset more easily. A set of chamfers are positioned on the movable and fixed jaws to force the stopper to a central desired position on the movable jaw and the fixed jaw to a central desired position on the bottle. A stopper catcher is positioned so that the stopper cannot fly off.

8 Claims, 5 Drawing Sheets

BOTTLE STOPPER REMOVER

BACKGROUND OF THE INVENTION

1. Field of the Invention

This invention relates generally to bottle stopper removers, and more particularly to an improved remover specifically useful in extracting a stopper from a wine or champagne bottle, especially one sealed with a molded plastic stopper.

2. Description of Related Art

Invention and use of bottle stopper removing devices is known to the public, as they are commonly used for opening bottles produced primarily by the wine industry. Such stopper removers include the well known cork-screw type, the opposing prong type which is used in the restaurant industry, the injected gas type, and two further types which are most closely related to the present invention, the pivoted separable jaw type, of which Hazard, Spriggs, and Crudgington, Jr., described below, are examples, and the separable jaw, screw leverage type, of which the present invention is an example. Hazard U.S. Pat. No. 58,820 teaches an instrument for removing wires from bottles. The invention consists of an arm or bar, fork shaped at one end, which is placed upon and about the neck of a bottle in combination with a hook lever so hung to the fork shaped arm that when the latter is over the neck of the bottle, the hook lever can be engaged with the loop fastener of the cork in such a manner that by properly operating the lever it will draw the fastener loop off the top of the cork leaving the cork free to be removed. Richel U.S. Pat. No. 2,162,445 claims a jar wrench having a jar-gripping means, and a bracket upstanding from the gripping means, and a manually tightening member, and a spiral cap screwing spring with one end anchored to a portion of the tightening member, and a swivel means carried by the tightening member with the other end of the spring anchored to it. This device is particularly capable of removing the cap from a preserve jar or for handling the jar when hot. Spriggs U.S. Pat. No. 4,018,110 documents a hand manipulable device for removing bottle stoppers comprising upper and lower bifurcated jaws engageable about the neck of a bottle between the shoulder and mouth of the bottle for engagement of the upper jaw below the stopper head so that a spreading of the jaws effects an upward withdrawal of the stopper. A retaining arm is fixed to the upper jaw and extends generally centrally over it in outwardly spaced relation for engagement over the head of the stopper in a manner so as to retain the stopper subsequent to release from the bottle. Burns, Jr. U.S. Pat. No. 4,422,355 discusses a device for controllably removing a bottle stopper from a bottle containing a liquid and natural high pressure gas, such as a sparkling wine, in which the stopper is conventionally held in place, at least in part, by a wire hood. There is a clamp for gripping the bottle adjacent to the pouring lip, but free of the wire hood. There is also a clamp for gripping the stopper, the clamp permitting a loosening of the wire hood. There is a handle for applying an axial turning movement to the gripping device to torsionally remove the stopper from the bottle opening, which removal is under control and at no time will permit an uncontrolled discharge of the stopper. Valtri et al., U.S. Pat. No. 4,756,214 claims an apparatus for removing a stopper from a bottle comprising a threaded shaft member, a bottle-gripping member slidably and rotatably coupled to the shaft member, and a stopper-gripping member threaded on the shaft member. The bottle gripping and stopper-gripping members are lightly constructed and relatively flexible, but are buttressed and made rigid and operative by their cooperation with a slidable collar which encircles them and may selectively be positioned for stopper removal or for application of the apparatus to a bottle for stopper removal. Bar-Noy U.S. Pat. No. 4,768,403 exhibits a combination of a bottle screw-threaded twist-off cap opener and a handle which facilitates the holding of the bottle when it is held for pouring its contents. Crudgington, Jr. U.S. Pat. No. 4,875,394 demonstrates improvements in a hand manipulated device with bifurcated jaws for removing mushroom shaped stoppers from sparkling beverage bottles wherein each jaw contains a recess enabling the device to be repositioned directly around the stopper's stem and on top of the bottle when the stopper has been partially removed, thereby providing a means for additional leverage and lift capability; pivotally interconnected upper and lower levels which are interlocked, thereby eliminating the likelihood that the pivot action might be either too tight or too loose, and enabling the insertion of a hidden spring which eliminates the need for an exposed and perhaps hazardous spring between the handles: and without an exposed spring, grip means is permitted beneath the handles that provides an alternate method of stopper removal; the addition of clips to the upper jaw to prevent the stopper from ricocheting out from under the retaining arm; and a retaining arm which is either flexible or movable thereby permitting a downwardly directed and manually exerted counter force to be applied to said stopper, enabling the stopper to be removed slowly, if desired. St. Denis U.S. Pat. No. 5,347,889 describes a device for removing either a cork or a mushroom-shape stopper from a bottle. It includes a support frame having a bottom ring member adapted to engage the neck of a wine bottle, a top cap member with a threaded hole extending through it and at least two circumferentially spaced longitudinal support members extending between the top cap and bottom ring. A threaded shaft having an upper end and a lower end is mounted in the top cap threaded hole, this shaft having a handle mounted on the upper end. A stopper gripping and pulling member is included for a mushroom-shaped stopper comprising a bridge member connected to the lower end of the threaded shaft such that the threaded shaft is free to rotate relative to the bridge member while being fixed against relative axial movement, guide-ways in the bridge member for receiving the support frame longitudinal support members thereby preventing rotation of the bridge member, a pair of opposed stopper gripping arms extending downwardly from the bridge member, these gripping arms having at the lower ends, inwardly extending gripper dogs adapted to slide downwardly over the top of a mushroom-shaped stopper in a bottle and grip the stopper for pulling, and these gripper arms being further adapted to swing outwardly from the bridge member to release a pulled stopper. Also included is a cork pulling member comprising a stem portion with a handle at one end and cork screw portion at the other end, the cork screw stem extending through an axial hole in the threaded shaft with the cork screw handle projecting above the threaded shaft handle, the cork screw member being adapted to be screwed into a cork in a bottle by turning the cork screw handle and being adapted to pull the cork from the bottle by turning the handle of the threaded shaft whereby the thread shaft handle engages the cork screw handle thereby lifting the cork screw and cork.

The prior art, primarily embodied in the separable jaw, screw leverage type of stopper remover as taught by Richel, St. Denis, Valtri et al, and Burns Jr. provides a basic understanding of this approach. However, these devices are deficient, from a practical point of view, in one or more ways, as with St. Denis, which is a relatively long device as necessitated by its design approach, and Burns Jr. which has ungainly outwardly extending side arms., making these devices unsuitable for being carried and used by waiters in the restaurant industry. Richel is rather ungainly also, and it, as well as Valtri et al, suffer a major disadvantage of not being adaptable for replacement of the stopper gripping means so as to be useful for all stopper types and configurations. The present invention fulfills this need and provides further related advantages as described in the following summary.

SUMMARY OF THE INVENTION

The present invention is an improved bottle stopper remover for wine and champagne bottles and is especially useful for stoppers made of molded plastic because these stoppers are not amenable to most stopper removers including the stopper screw type. The invention is made up of a compact body having a fixed jaw and a movable jaw positioned in parallel on one side of the body. At one end of the body is a hand crank which applies a force between the fixed and movable jaws tending to draw them apart. The fixed jaw is constructed to rest on a flared section of the neck of the bottle just under the uppermost lip of the bottle. The moveable jaw rests upon the uppermost lip of the bottle, between it and the stopper. As the movable jaw is drawn away from the fixed jaw, the fixed jaw presses downwardly upon the flared section of the bottle's neck, while the movable jaw pushes upwardly upon the stopper. The stopper is, in this way, lifted from the bottle by simple leverage. A stopper catcher is fitted above the movable jaw so that the stopper is not able to fly off under gas pressure forces released from the bottle.

Thus it is an object of the present invention to provide a bottle stopper remover that is compact and provides a simple and quick means for removing the stopper of wine bottles and the like. It is another object of the invention to provide such a remover that is operable even when the space between the stopper and the bottle lip is quite small. It is yet another object of the invention to provide such a remover that is able to exert a large force on a bottle stopper through mechanical advantage so that the manual force required is relatively small, and where such a force is generated gradually so that the stopper is removed smoothly. It is yet another object of the present invention to provide such a remover wherein the alternate sets of the movable jaws are able to be used, and where the replacement of one set with the next is a quick and easy procedure. It is a final and important object of the invention to provide a means by which the stopper of a wine bottle is forcefully centered on the movable jaws of the device.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention, a device for removing a stopper from a wine or champagne bottle or the like. In such drawings.

DETAILED DESCRIPTION OF THE PREFERRED EMBODIMENT

Figure 1:
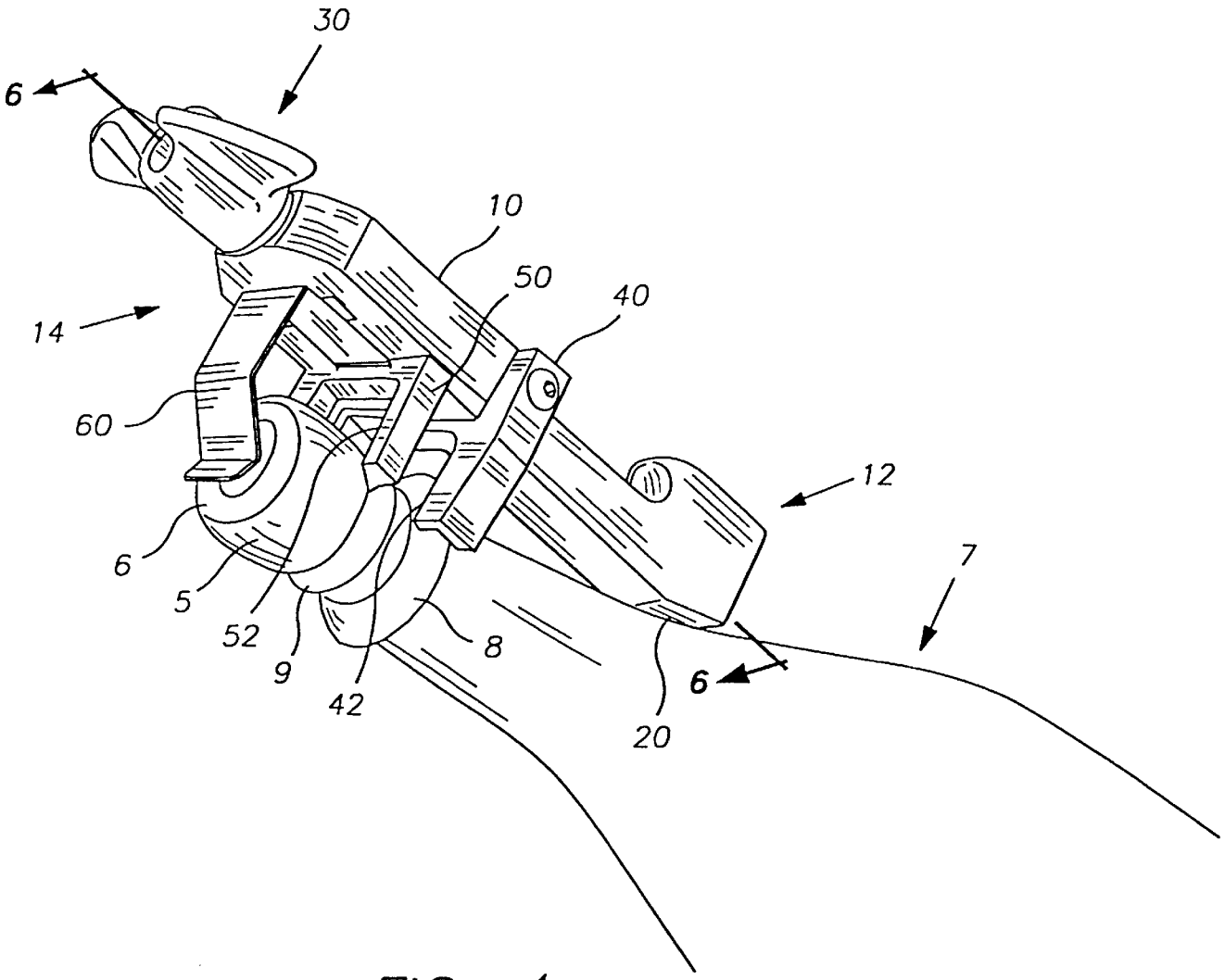
FIG. 1 is a perspective view of the preferred embodiment of the present invention, particularly showing the invention as it is being inserted onto the neck of a bottle, and shown prior to being fully seated on the bottle.

The above described drawing figures illustrate a device for removing a stopper 5 from a bottle 7 such as a wine bottle or a champagne bottle. As shown in FIG. 1, the apparatus is made up of an elongate rigid body 10 providing a bottle rest surface 20 near one end 12 of the body 10, and a screw means 30 for pulling the stopper 5 from the bottle 7, at the other end 14 of the body 10. A fixed jaw 40 is integral to the body 10 and extends away from it at a right angle. The fixed jaw 40 provides a first U-shaped notch 42. A movable jaw 50 is engaged with the body 10 so as to be movable with respect to the body 10 and extends, as well, at a right angle from the body 10, while in parallel and spaced apart from the fixed jaw 40. Mounted on, and positioned above the movable jaw 50, is a stopper holding means 60 which prevents the stopper from flying out of the movable jaw 50 upon the stopper's release from the bottle. Therefore, with the fixed jaw 40 positioned against a flared portion 8 of the bottle 7, and with the movable jaw 50 positioned between the stopper 5 and a top lip 9 of the bottle 7, a screw means 30 draws the movable jaw 50 away from the fixed jaw 40 to push the stopper 5 from the bottle 7.

Figure 6:
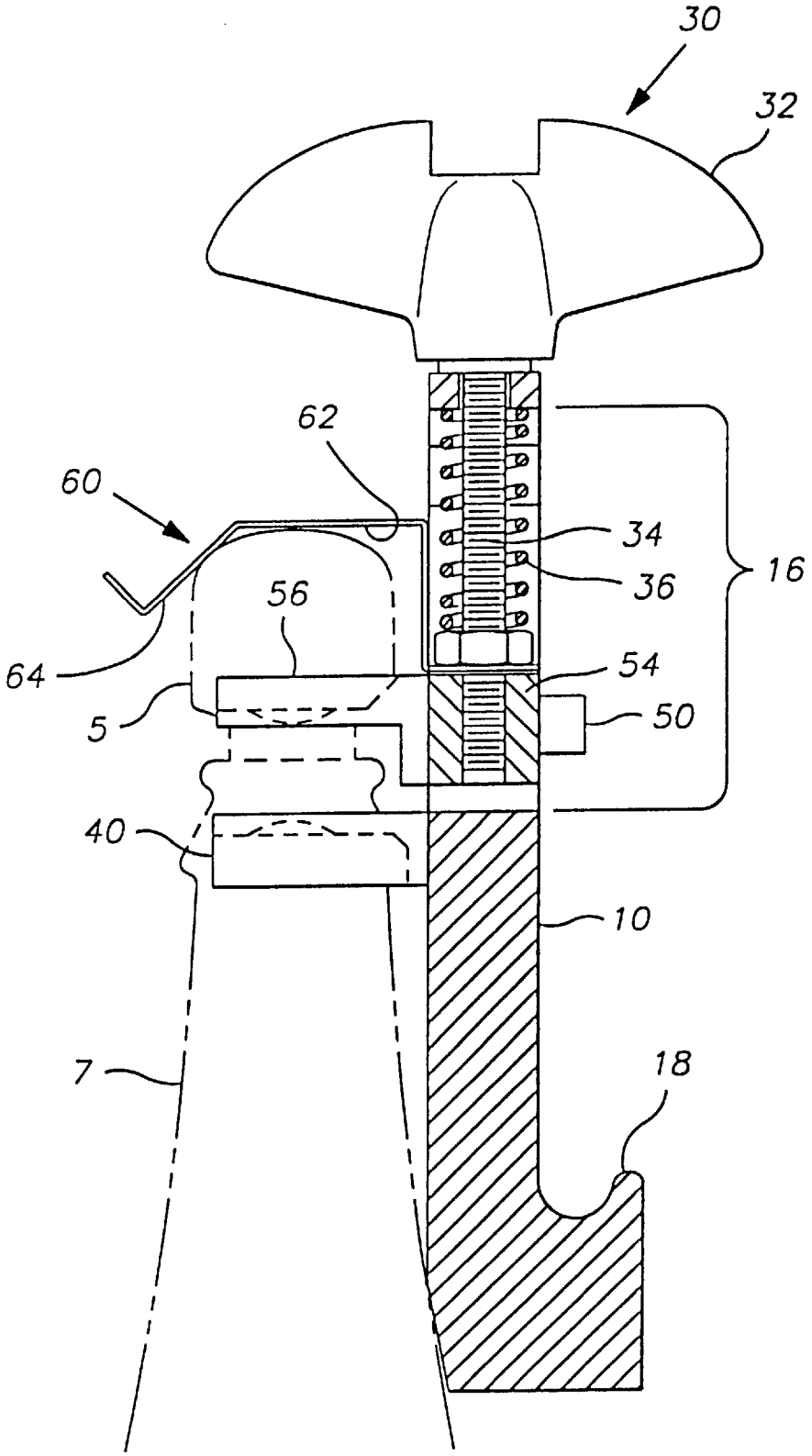
FIG. 6 is a cross-sectional view of the invention taken along line 6—6 in FIG. 1, and particularly showing the manner in which the screw means of the invention is engaged with the traveling block of the invention.

As best seen in FIG. 6, the movable jaw 50 is mechanically interlocked with a traveling block 54, which in turn, is threadably engaged with threaded stud 34 of the screw means 30. The body 10 provides a slot 16 within which the traveling block 54 is engaged and is able to move linearly, but cannot rotate within the slot 16. The screw means 30 includes a preferably winged-head portion 32, a threaded shaft portion 34, and a spring 36 fitted around the threaded shaft 34.

Figure 2:
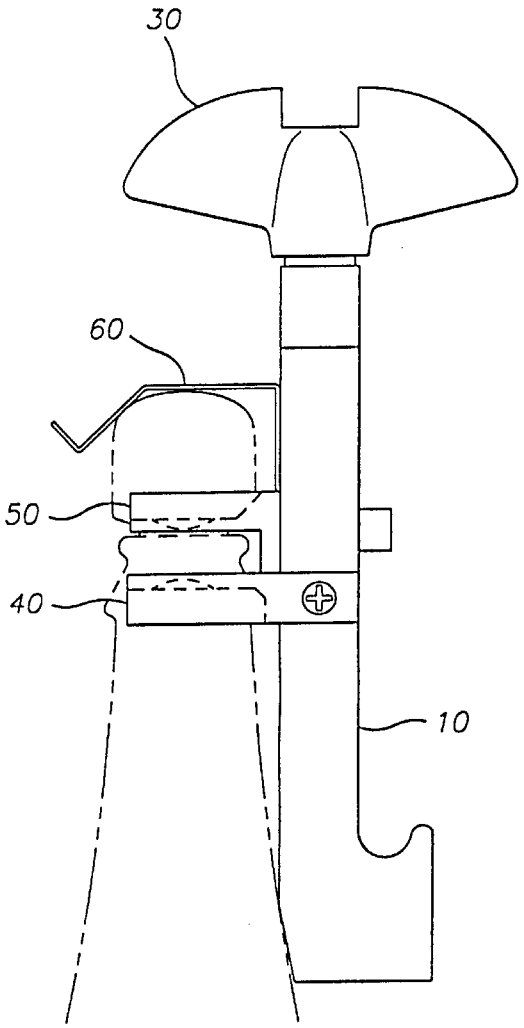
FIG. 2 is a side elevational view thereof, particularly showing the invention fully inserted onto the bottle prior to lifting the stopper of the bottle.
Figure 3:
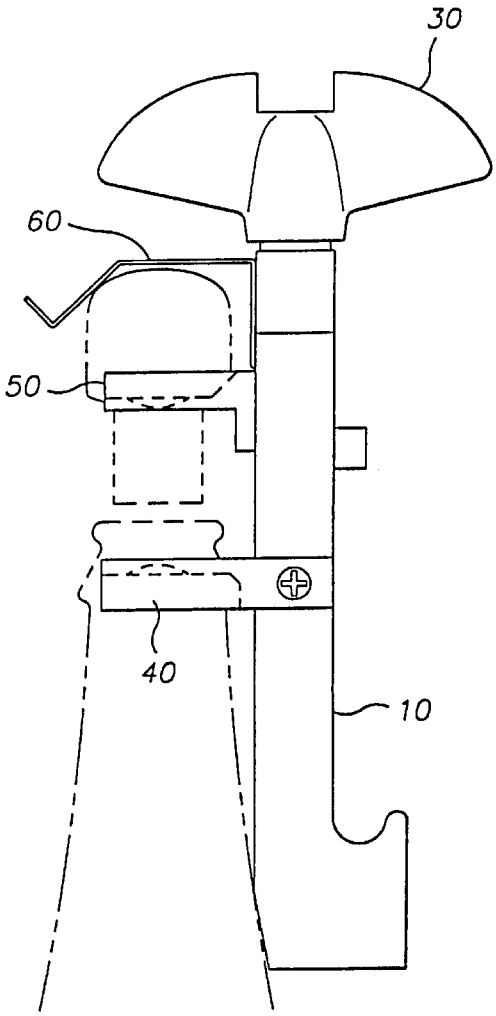
FIG. 3 is a side elevational view thereof similar to FIG. 2, particularly showing the positions of key moving elements of the invention after the stopper of the bottle has been removed.
Figure 5:
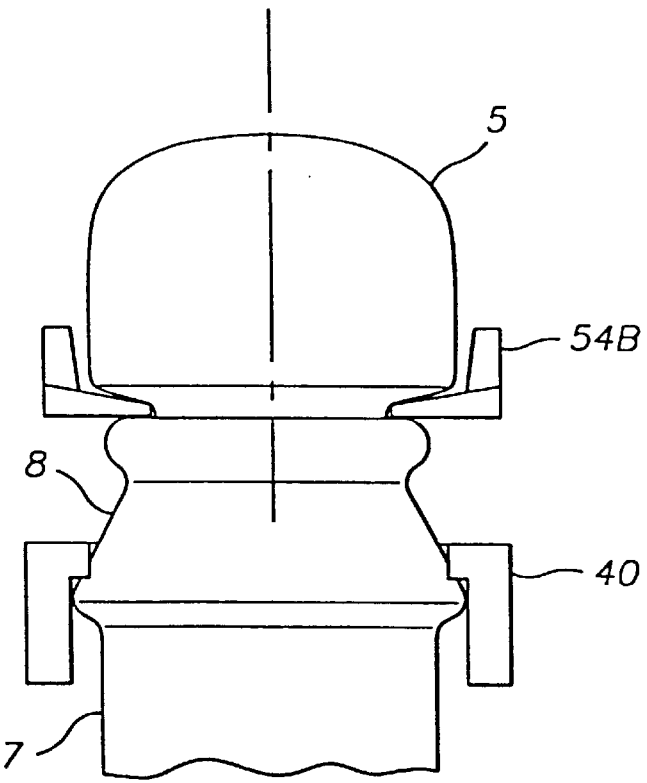
FIG. 5 is a front elevational view thereof showing only the movable jaw and the fixed jaw of the invention, and the positions of engagement of these elements with the bottle and stopper when the stopper is a typical molded plastic type stopper.
Figure 4:
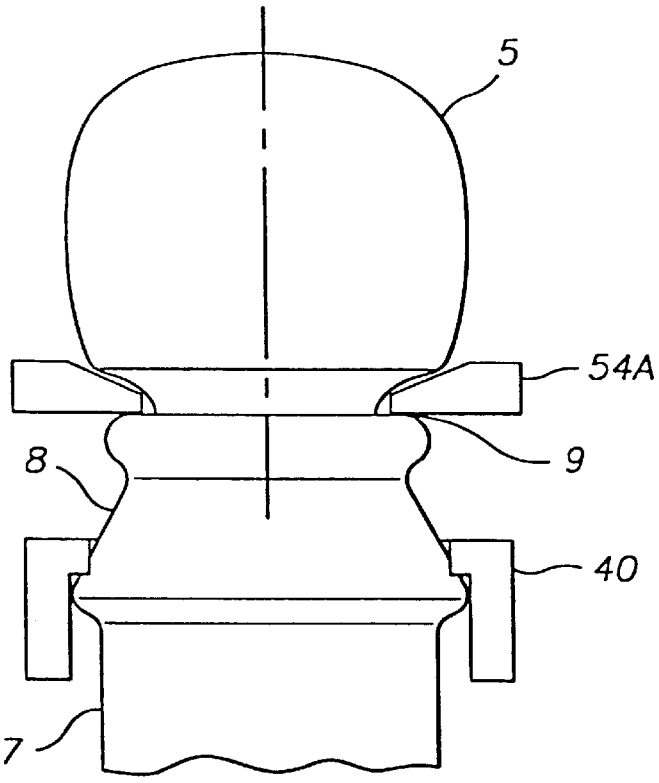
FIG. 4 is a front elevational view thereof showing only the movable jaw and the fixed jaw of the invention, and the positions of engagement of these elements with the bottle and stopper when the stopper is a typical stopper type stopper.

As seen in FIGS. 2, 3 and 6, the stopper holding means 60 is fixed to the movable jaw 50 and moves with it. The stopper holding means 60 includes a surface 62 in, at least near contact with a head 6 of the stopper 7, and a laterally positioned surface 64 for preventing the stopper 7 from flying out of the movable jaw 50.

The body provides a hook means 18 for engaging a hand for holding the apparatus in position on the bottle 7 during stopper removal. This is desirable since one hand is able to encircle the bottle as well as the apparatus while providing a slight manual pressure to force the apparatus against the bottle's side wall 8 and ensure that the apparatus is engaged with the bottle 7 and stopper 5. This relationship is improved by a slight downward pressure on the apparatus, and this is strongly facilitated by the hook means 18. The other hand is then free to be used to turn the winged-head portion 32 of the screw means 30.

Figure 7A:
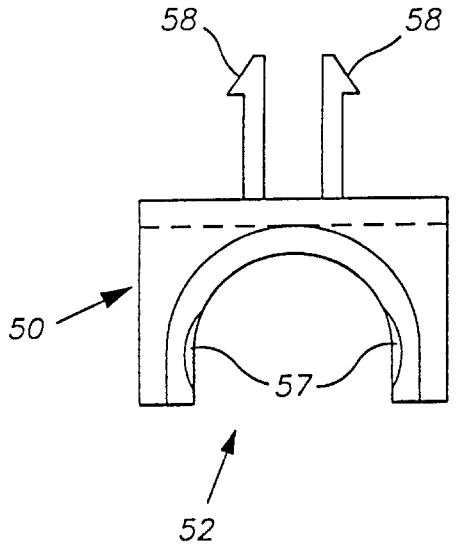
FIG. 7A is a top plan view of a preferred embodiment of the moveable jaw of the invention, particularly showing a U-shaped stopper engagement portion and a pair of mounting legs.
Figure 7B:
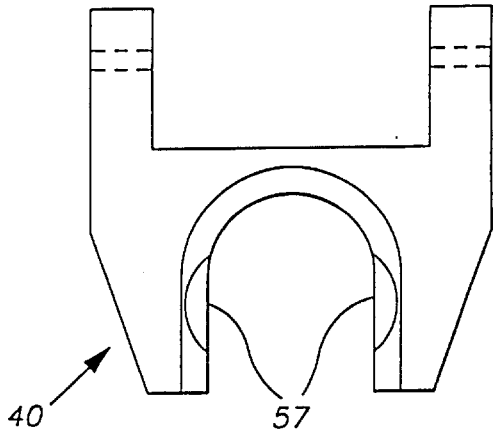
FIG. 7B is a bottom plan view of a preferred embodiment of the fixed jaw of the invention, particularly showing a U-shaped stopper engagement portion and a pair of mounting legs.
Figure 8:
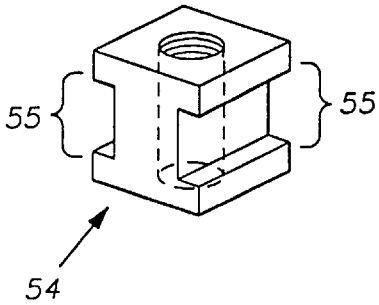
FIG. 8 is a perspective view of the traveling block of the invention.

The movable jaw 50 provides a pair of spaced apart legs 58 as best seen in FIG. 7A, the legs 58 straddle the traveling block 54, as best seen in FIG. 8, and are fitted within a pair of lateral grooves 55 in the traveling block 54 respectively. With the screw means 30 removed from the body 10, the movable jaw 50 and the traveling block 54, into which it is engaged, may be moved to the top end of the slot 16 of the body 10. At this point, the slot 16 is wider so as to accommodate the removal of the movable jaw 50 and the traveling block 54 so that the movable jaw 50 may be replaced by one of an alternate shape for improved results on stoppers 5 of various shapes and sizes, and where the space between stopper and bottle may vary. The movable jaw 50 provides a pair of opposing chamfers 57, as best seen in FIG. 7A, setting a preferred position for the stopper on the movable jaw. These chamfers 57 are concave surfaces impressed into the jaw 50 on opposing sides of the stopper 5. They provide a low point for the stopper to preferably move to when the jaw 50 is applying pressure to the stopper 5. In this way the stopper 5 does not tend to move out of the U-shaped notch 52. Likewise, the fixed jaw 40 provides a pair of opposing chamfers 57 setting a preferred position for the bottle neck on the fixed jaw. These chamfers 57 are downwardly facing concave surfaces impressed into the jaw 40 on opposing sides of the bottle 7. They provide a low point for the bottle to preferably move to when the movable jaw 50 is applying pressure to the stopper 5.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. An apparatus for removing a stopper from a bottle, the apparatus comprising:

an elongate body providing a bottle rest surface at one end of the body, and a screw means for pulling the stopper from the bottle, at the other end of the body;

a fixed jaw integral with the body and extending at a right angle therefrom, the fixed jaw providing a first U-shaped notch of a size permitting the fixed jaw to rest on opposing sides of a neck of the bottle;

a movable jaw extending at a right angle from the body, in parallel and spaced apart from the fixed jaw, the movable jaw providing a second U-shaped notch of a size permitting the movable jaw to engage opposing sides of a stem of the stopper, the movable jaw being mechanically interlocked with a traveling block, the block threadably engaged with the screw means; and a means for holding the stopper against the movable jaw;

whereby with the fixed jaw positioned against a side wall of the bottle, and with the movable jaw positioned between the stopper and a top surface of the bottle, the screw means draws the movable jaw away from the fixed jaw to pull the stopper from the bottle.

2. The apparatus of claim 1 wherein the body provides a slot therein, the traveling block engaged therewith, and linearly movable therein as driven by the screw means.

3. The apparatus of claim 2 wherein the screw means includes a wing-headed screw having a threaded shaft, and a spring fitted around the threaded shaft.

4. The apparatus of claim 3 wherein the stopper holding means is fixed to the movable jaw and moves therewith, the stopper holding means including a surface in contact with a head of the stopper, and a lateral surface positioned for preventing the stopper from flying out of the movable jaw.

5. The apparatus of claim 4 wherein the body provides a hook means for engaging a hand for holding the apparatus in position on the bottle during stopper removal.

6. The apparatus of claim 2 wherein the movable jaw provides a pair of spaced apart legs, the legs straddling the traveling block and adapted for being fitted within a pair of spaced apart lateral grooves in the traveling block respectively for mechanically and movably interlocking the movable jaw and the traveling block with the body.

7. The apparatus of claim 2 wherein the movable jaw and the fixed jaw, each provides a pair of spaced apart legs, the legs straddling the traveling block and the body, respectively, the legs of the movable jaw each being adapted for fitted within one of a pair of spaced apart lateral grooves in the traveling block for mechanically and movably interlocking the movable jaw and the traveling block with the body.

8. The apparatus of claim 2 wherein the movable jaw and the fixed jaw, each provides a pair of opposing chamfers the chamfers positioned for communicating with the stopper and the bottle, respectively for setting a preferred position for the stopper on the movable jaw and a preferred position for the lower jaw on the bottle.

* * * * *